US010465906B2

(12) United States Patent
Le Borgne et al.

(10) Patent No.: US 10,465,906 B2
(45) Date of Patent: Nov. 5, 2019

(54) LIGHTER AND METHOD FOR LINING A LIGHTER WITH A PROTECTIVE ELEMENT

(71) Applicant: HAMEUR SA, Luxembourg (LU)

(72) Inventors: André Le Borgne, Guidel (FR); Frédéric Thiec, Ploemeur (FR)

(73) Assignee: HAMEUR SA, Luxembourg (LU)

( * ) Notice: Subject to any disclaimer, the term of this patent is extended or adjusted under 35 U.S.C. 154(b) by 81 days.

(21) Appl. No.: 15/745,436

(22) PCT Filed: Jul. 19, 2016

(86) PCT No.: PCT/EP2016/067118
§ 371 (c)(1),
(2) Date: Jan. 17, 2018

(87) PCT Pub. No.: WO2017/013089
PCT Pub. Date: Jan. 26, 2017

(65) Prior Publication Data

US 2018/0216821 A1 Aug. 2, 2018

(30) Foreign Application Priority Data

Jul. 20, 2015 (FR) ..... 15 56869
Sep. 10, 2015 (FR) ..... 15 58388

(51) Int. Cl.
*F23Q 2/36* (2006.01)
*F23Q 2/28* (2006.01)

(52) U.S. Cl.
CPC ..... *F23Q 2/36* (2013.01); *F23Q 2/287* (2013.01)

(58) Field of Classification Search
CPC ..... F23Q 2/32; F23Q 2/36; F23Q 2/42; F23Q 2/287

(Continued)

(56) References Cited

U.S. PATENT DOCUMENTS 3,597,140 A * 8/1971 Rabe ..... F23Q 2/163 431/131
4,457,699 A * 7/1984 Hattori ..... F23Q 2/163 222/3

(Continued)

FOREIGN PATENT DOCUMENTS

DE 84 08 596 U1 6/1984
DE 88 07 488 U1 9/1988

OTHER PUBLICATIONS

Database EPODOC [Online] European Patent Office, Database accession No. BG-10570501-U abstract & BG 105 705 U (Akson Balgarija Ood [BG]), Dec. 31, 2001, abstract, The Hague, NL.

*Primary Examiner* — Avinash A Savani
*Assistant Examiner* — Aaron H Heyamoto
(74) *Attorney, Agent, or Firm* — Im IP Law; C. Andrew Im; Chai Im

(57) ABSTRACT

A lighter includes a lighter body having a fuel reservoir with a fuel-releasing valve, and an assembly such as a piezoelectric system, an electric system or system having a friction wheel rotatable by a user to produce sparks directed to the fuel released by the valve. The friction wheel assembly is mounted on the lighter body such that at least part of the friction wheel is exposed to be handled and rotated by the user. A valve actuator is depressible to actuate the valve and release the fuel. A protective element is mounted on the lighter body and consists of multiple layers. The protective element has a thickness ranging from 25-200 μm and includes an outer protective film formed by a plastic film coated with an aliphatic polyurethane layer having a thickness ranging from 10-75 containing between 30 and 100% solids, depending on the required degree of smoothness.

13 Claims, 3 Drawing Sheets

(58) Field of Classification Search
USPC ..... 431/126, 253, 344
See application file for complete search history.

(56) References Cited

U.S. PATENT DOCUMENTS

| | | | | |
|---|---|---|---|---|
| 4,956,227 | A * | 9/1990 | Hirayama | B32B 17/10009 428/331 |
| 2004/0142765 | A1* | 7/2004 | Kennedy, III | A63B 45/02 473/351 |
| 2006/0132919 | A1* | 6/2006 | Schnell | B29D 11/00125 359/565 |
| 2012/0129631 | A1* | 5/2012 | Sullivan | A63B 37/0003 473/373 |
| 2017/0065855 | A1* | 3/2017 | Sullivan | A63B 37/0076 |

* cited by examiner

LIGHTER AND METHOD FOR LINING A LIGHTER WITH A PROTECTIVE ELEMENT

RELATED APPLICATIONS

This application is a § 371 application from PCT/EP2016/067118 filed Jul. 19, 2016, which claims priority from French Application No. 15 56869 filed Jul. 20, 2015 and French Application No. 15 58388 filed Sep. 10, 2015, each of which is incorporated herein by reference in its entirety.

TECHNICAL FIELD OF THE INVENTION

The subjects of the present invention are a lighter and a method for covering the body of a lighter with a protective element.

PRIOR ART

A lighter conventionally comprises a lighter body provided with a reservoir and with an igniter. The reservoir is a reservoir of fuel. The igniter may be of various types, notably an igniter of piezoelectric type, a friction igniter or simply an electric igniter. A friction igniter comprises a wheel which generates friction on contact with a sparking flint. In the latter instance, lighting a lighter involves manipulating the wheel, generally using the thumb. When the thumb finishes manipulating the wheel it then almost simultaneously depresses a push-rod of a valve which releases a fuel. The release of the fuel occurs at the very moment that the spark is produced, thus generating the flame.

In the case of piezoelectric igniters, the push-rod of the valve is operated by one of the user's digits, generally his thumb. As the thumb depresses this push-rod a first movement of this push-rod compresses a spring. Continued pressure thereon abruptly releases the spring. This spring then strikes a piezoelectric quartz which likewise produces a spark. The production of the spark is also simultaneous with the release of the fuel through the consecutive action on the push-rod which opens the fuel valve.

Lighters are very widespread and are often used for promotional purposes.

The type of film used for decoration (sleeve or label) is either gloss or matte. The disadvantage with this type of film is that it is not very good at resisting scratching and that it can easily be pulled off.

OBJECT OF THE INVENTION

The present invention seeks to overcome these disadvantages.

To this end, according to a first aspect, the present invention relates to a lighter comprising:

- a lighter body comprising a reservoir of fuel with a valve to release the fuel therefrom;
- an assembly using a piezoelectric system, an electric system, or a lighter flint system with a wheel that can be turned by a user to produce sparks directed toward the fuel released from said valve, said lighter flint wheel assembly being mounted on said lighter body with at least part of it exposed to be handled and rotated by the user;
- a valve actuator that can be depressed to actuate said valve and release said fuel;
- a protective element mounted on said lighter body.

The protective element is made up of a plurality of layers and has a thickness of between 25 and 200 μm and comprises an exterior protective film made up of a plastic film to which is added, by coating, a layer of aliphatic polyurethane with a thickness of between 10 and 75 μm, with between 30 and 100% solid content depending on the degree of softness to the touch required.

The decoration of lighters of the prior art has low resistance to the scratching and pulling-off of the protective film.

Through these measures, the protective film has better resistance to scratching, to pulling-off and a better softness to the touch.

According to one embodiment, the exterior protective film comprises an adhesive substance designed to hold the protective element on the body of the lighter.

According to another embodiment, the protective element comprises a backing film positioned on a layer lower than the protective film, said backing film comprises a first face to which an adhesive substance is added in order to hold the protective film on the backing film.

In this way, the protective element is made up of two films (protective film and backing film), improving the resistance to scratching and to pulling-off while at the same time maintaining better softness to the touch.

In one embodiment, the backing film comprises a second face comprising an adhesive substance designed to hold the exterior protective element on the body of the lighter.

In one embodiment, the protective element has a thickness of between 30 and 60 μm.

In one embodiment, the plastic film has a thickness of between 10 and 40 μm.

In one embodiment, the backing film has a thickness of between 15 and 125 μm.

In one embodiment, the coefficient of friction of the exterior protective film is between 0.40 and 0.70.

In one embodiment the tack of the exterior protective film is between 100 and 140 mN.

In one embodiment, the protective element comprises a retaining mechanism to resist removal of said protective element from the lighter body.

In one embodiment, the protective element comprises a lighter-decoration zone.

In one embodiment, the protective element is in the form of a sleeve tailored to the shape of the lighter.

According to a second aspect, the present invention relates to a method for covering the body of a lighter by means of a protective element.

Because the advantages, objects and particular features of this method are similar to those of the lighter that forms a subject of the present invention, they are not recalled here.

BRIEF DESCRIPTION OF THE FIGURES

Further advantages, objects and features of the present invention will become apparent from the following description given, for explanatory and entirely nonlimiting purposes, with reference to the attached drawings in which.

DESCRIPTION OF EXEMPLARY EMBODIMENTS OF THE INVENTION

The object of the following description is to demonstrate the resistance and improvement in touch of the protective film as compared with a gloss film and a matte film. Hereinafter, the protective film will be referred to as a soft touch film ("soft touch" being a registered tradename).

The protective film comprises a plurality of layers (is multilayer) and on the final layer, referred to as the exterior layer, comprises the soft touch film.

The soft touch film tested corresponds to the protective element the thickness of which is 47 μm.

The gloss film has a thickness is of 30 μm and the matte film has a thickness is of 20 μm.

The three films compared are made up of the combination of an opaque printed adhesive plastic film with one or two transparent films depending on the finish.

The measurement protocol is as follows and is used to measure the friction and the adhesion.

The system used makes it possible to take qualificative measurements:

in terms of feel, in terms of orthogonal touch (tacky or sticky aspect), in terms of tangential touch (slippery/firm), and even in terms of scratching (plastic deformation/scratching transition).

In addition, the system makes it possible, in the case of transparent materials, to observe precisely the actual area of contact between indenter and sample using an inverted microscope.

Figure 1:
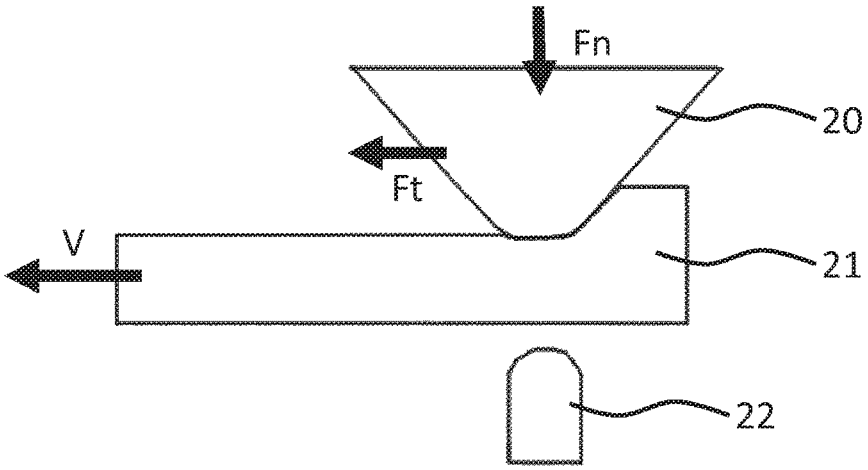
FIG. 1 depicts a block diagram of the measurements.

FIG. 1 depicts a block diagram of the measurements. This figure shows an indenter 20, a test specimen 21 and a camera 22. The indenter is used in the indentation technique to measure the hardness of a material.

The system is made up of a test bench the motors of which are controlled in such a way as to:

apply a movement or a longitudinal force to the specimen, bring the specimen into contact with a contact antagonist, observe the area of contact between the two surfaces present, qualify the resultant normal force and tangential force.

The entire system is characterized by the measurement of force as a function of displacement within ranges which start from a few millinewtons and extend as far as fifty newtons, and with micrometric precision on the displacement.

This apparatus is intended to measure normal and/or tangential forces applied to specimens via the indenter 20 as a function of a normal or tangential relative displacement.

All the cycles are controlled by one and the same software (Tribolog, registered tradename) and are capable of taking several types of measurement depending on the sensors and actuators in place on the basic mechanical structure.

Motorizing the transverse axis opens up the possibility of performing friction tests (tribometer) or scratching tests as well as transverse force gradients.

In order to analyze the rasping/roughness of the various films, a characterization of their surface finish is performed.

In order for the characterization of the surface finish in terms of touch to be independent of the various surface coatings (transparent layer, adhesion primer), each film is fingerprinted.

These fingerprints are then mapped using a scanning 3D profilometer. The system is equipped with a contactless optical sensor. The map is created over an area of 1×1 mm with a step length of 2 μm.

The sensor used has a measurement range of 200 μm with a vertical resolution of 7 nm and a spot size with a diameter of 2 μm.

The films are cut beforehand and stuck to a glass slide (laboratory microscope slide) for each film and each measurement type.

Two types of analysis are carried out:

a measurement of the adhesion force, using a silicone hemisphere (Rhodia 4511, registered tradename) having a tack according to the following protocol:
indentation depth 500 μm,
equivalent indentation force (for silicone 4511) 60 mN,
stabilization time before unsticking 60 seconds,
unsticking.

a linear friction measurement using a hemispherical indenter made of silicone (RTC 141, registered tradename) with a Shore 0 hardness equal to 54, coated with a lens-cleaning cloth with a normal force of 1.5 N over a travel of 10 mm.

A characterization of the surface conditions of the various finishes produced is summarized in the table below.

| Criteria | Gloss film | Matt film | Soft touch film | Units |
|---|---|---|---|---|
| Ra | 0.21 | 0.57 | 0.55 | microns |
| Rsk | 0.79 | 0.36 | 0.18 | |
| Rku | 15.9 | 3.24 | 2.92 | |

The criterion Ra is the arithmetic mean roughness of the profile. Ra is used as an overall evaluation of the amplitude of the roughness of the profile but provides no information as to the spatial distribution of the irregularities of the profile or as to the shape of the profile. Ra is useful for random (stochastic) rough surfaces machined using tools that do not leave very many marks on the surface, such as sand-blasted, milled or polished surfaces.

The criterion Rsk is the asymmetry of the profile: asymmetry of the distribution of the heights. This parameter is important because it provides information as to the morphology of the surface condition. A negative Rsk value corresponds to a surface exhibiting spikes and protuberances extending above the surface, whereas a positive value corresponds to a plateau surface with deep pores or scoring. This is therefore an important parameter in characterizing contact or lubrication functions. On the other hand, unlike Ra, this parameter provides no information regarding the amplitude of the roughness.

The criterion Rku is the flattening of the profile. This criterion characterizes the width of the height distribution.

It may be noted from the table that the gloss finish has a very low roughness.

The matte and soft touch films are very similar to one another in terms of amplitude.

All three films also exhibit an absence of graining.

Taking into account the measured values in terms of feel, the associated descriptive term is smooth (and not rough/rasp-like) whatever the finish produced.

Figure 2:
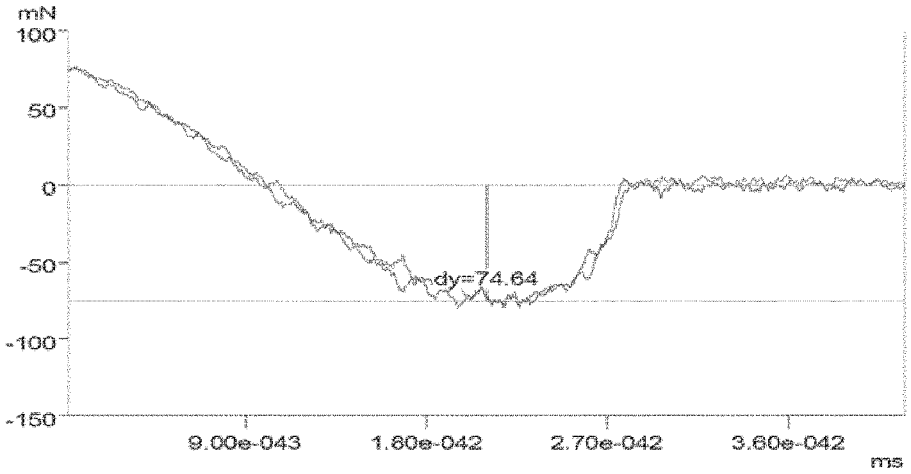
FIGS. 2 to 4 depict curves of the adhesion measurement.

FIG. 2 represents the measurement of adhesion for the gloss film.

Figure 3:
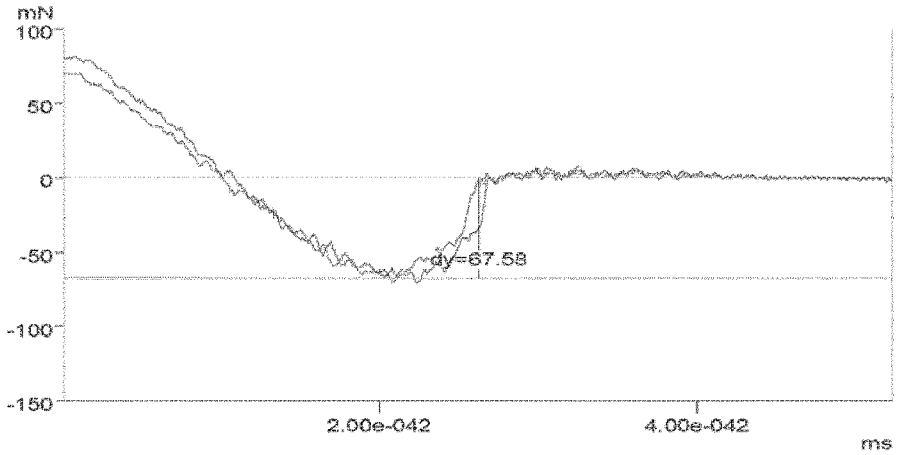

FIG. 3 represents the measurement of adhesion for the matte film.

Figure 4:
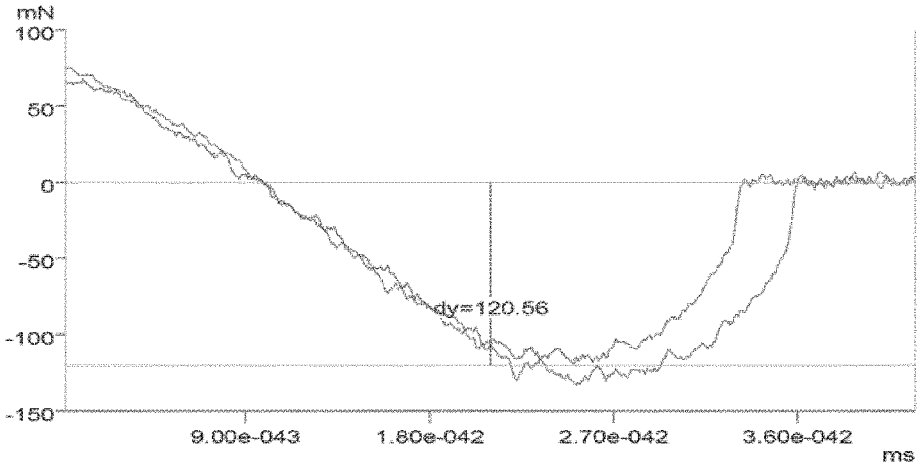

FIG. 4 depicts the measurement of adhesion for the soft touch film.

The various mean values from the two tack tests performed on each specimen are collated in the following table:

| Film: | Fa (mN) |
|---|---|
| gloss | 74.6 |
| matt | 67.6 |
| soft touch | 120.6 |

It can be seen immediately that the soft touch finish differs markedly from the other two finishes, particularly from the matte finish which has a near-similar surface roughness. The soft touch film has a tack that is almost twice as high as the others.

Figure 5:
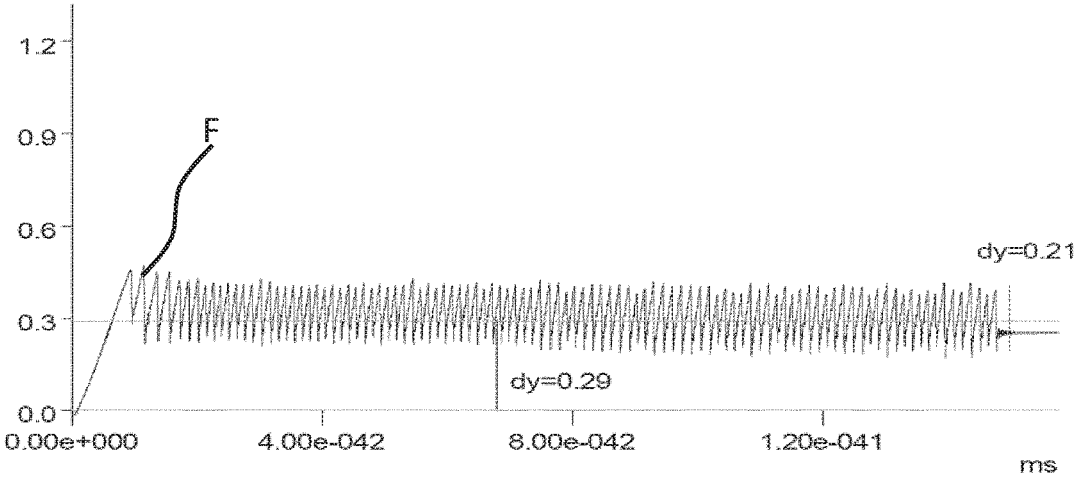
FIGS. 5 to 7 depict curves of the coefficient of friction measurement.
Figure 6:
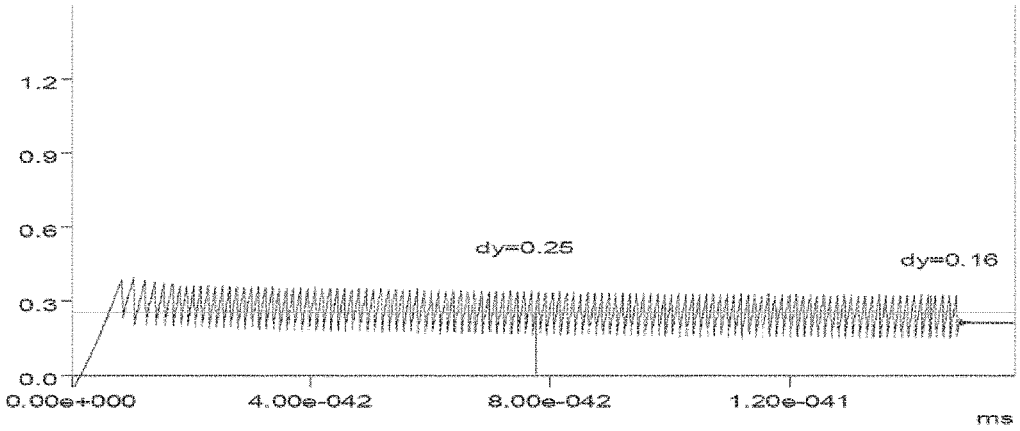
Figure 7:
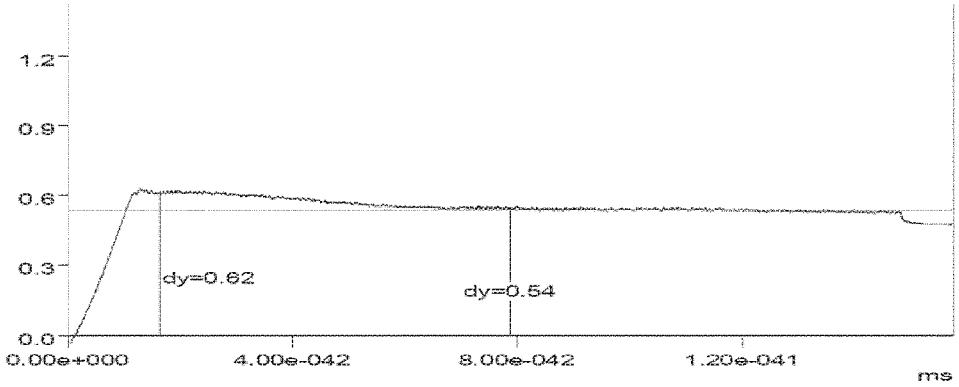

The measurement of the dry coefficient of friction on the various films is set out in FIGS. 5 to 7. FIG. 5 depicts a curve of the measurement of the coefficient of friction for the gloss film. FIG. 6 depicts a curve of the measurement of the coefficient of friction for the matte film. FIG. 7 represents a curve of the measurement of the coefficient of friction for the soft touch film. The reference F corresponds to the static coefficient F.

The measurement is taken by applying a constant normal load of 1.5 N and by moving the specimen.

In FIG. 5, the start of the curve obtained corresponds to the application of tangential tension between the indenter and the specimen defining the initial force gradient at the start of measurement.

When this force reaches the ratio Ft/Fn of the static coefficient of friction between specimen and indenter, there is relative slippage between indenter and specimen until the (lower) dynamic coefficient of friction value is reached. The entity then fluctuates between these two values of coefficient of friction. Jerky movement referred to as stick-slip is then observed.

FIG. 6 shows the same type of movement on the matte film.

In contrast with the comment above, on the soft touch film, the absence of this phenomenon under the same experimental conditions (see FIG. 7) is immediately noticeable.

Regarding the mean coefficients of friction, it is found (see next table corresponding to mean friction) that those of the gloss and matte films are very similar and low whereas that of the soft touch film is twice as high.

| Film: | Mean friction |
|---|---|
| gloss | 0.29 |
| matt | 0.26 |
| soft touch | 0.54 |

The measurements taken allow the various types of film to be differentiated markedly.

It becomes clear that the protective film with the soft touch coating displays characteristics that are very markedly different from the other films in terms of orthogonal touch with a coefficient of friction which is twice as high as the other films analyzed.

In addition, the soft touch protective film reduces the stick-slip phenomenon when this is found on the other films under the same experimental conditions.

Another measurement is taken in order to improve the protection of the lighter: resistance to scratching.

The conditions are as follows: use is made of a scoring stylus having a spherical tip of diameter 1 mm capable of applying a force of between 0 and 30 N.

The test is conducted on the decorated lighter (with the various possible versions of film) at each defined load; the stylus moves over a distance of between 40 and 50 mm, at a speed of approximately 45 mm/s.

The result is interpreted using the following levels:

1—No mark

2—Line present (slight deformation)

3—Film damaged, pierced through

4—Film pulled off

The result is interpreted according to the observation level hereinabove after inspection using a microscope with an 8 times magnification.

| Force | Gloss | Matt | Soft touch |
|---|---|---|---|
| 1N | 2 | 1 | 1 |
| 5N | 3 | 2 | 1 |
| 20N | 3 | 4 | 2 |
| 30N | 4 | 4 | 2 |

The soft touch film has a resistance to scratching which is twenty times as high as the gloss film and four times as high as the matte film. In addition, at 30 N, the soft touch finish exhibits only deformation (the presence of a line) whereas the other two films are pulled off.

The thickness of the types of film is as follows:

Gloss film: between 20 to 70 μm.

Matte film: between 20 to 70 μm.

Soft film: between 25 to 200 μm.

Figure 8:
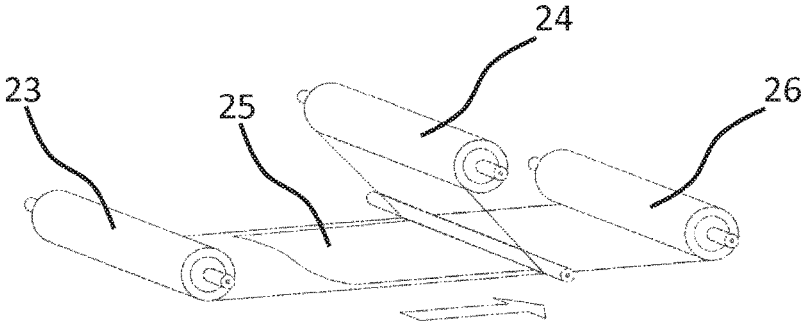
FIG. 8 depicts the construction of the protective element.

FIG. 8 depicts the construction of the protective element.

A roll of backing film 23 is unrolled to be assembled with the protective film 24. A layer of adhesive substance 25 is placed between the backing film 23 and the protective film 24. The arrow shows the direction of manufacture.

LIST OF PARTS

20 Indenter
21 Specimen
22 Camera
23 Backing film
24 Protective film
25 Adhesive substance
26 Protective element

The invention claimed is:

1. A lighter, comprising:

a lighter body comprising a reservoir of fuel with a valve to release the fuel therefrom;

an assembly using a piezoelectric system, an electric system, or a lighter flint system comprising a wheel that can be turned by a user to produce sparks directed toward the fuel released from said valve, said lighter flint wheel assembly being mounted on said lighter body with at least part of said lighter flint wheel assembly exposed to be handled and rotated by the user;

a valve actuator depressible to actuate said valve and release the fuel; and a protective element, mounted on said lighter body, comprises a plurality of layers, the protective element has a thickness of between 25 and 200 μm, the protective element comprises an exterior protective film comprising a plastic film coated with a layer of aliphatic polyurethane with a thickness of between 10 and 75 μm, and between 30 and 100% solid content depending on a required degree of softness to a touch.

2. The lighter as claimed in claim 1, wherein the exterior protective film comprises an adhesive substance configured to hold the protective element on said lighter body.

3. The lighter as claimed in claim 1, wherein the protective element comprises a backing film comprising a first face to which an adhesive substance is added to hold the protective film on the backing film.

4. The lighter as claimed in claim 3, wherein the backing film comprises a second face comprising the adhesive substance configured to hold the exterior protective film on the lighter body.

5. The lighter as claimed in claim 1, wherein the protective element has a thickness of between 30 and 60 μm.

6. The lighter as claimed in claim 1, wherein the plastic film has a thickness of between 10 and 40 μm.

7. The lighter as claimed in claim 3, wherein the backing film has a thickness of between 15 and 125 μm.

8. The lighter as claimed in claim 1, wherein a coefficient of friction of the exterior protective film is between 0.40 and 0.70.

9. The lighter as claimed in claim 1, wherein a tack of the exterior protective film is between 100 and 140 mN.

10. The lighter as claimed in claim 1, wherein the protective element comprises a retaining element to resist removal of the protective element from the lighter body.

11. The lighter as claimed in claim 1, wherein the protective element comprises a decoration zone.

12. The lighter as claimed in claim 1, wherein the protective element is in a form of a sleeve tailored to a shape of the lighter.

13. A method for covering the lighter body with the protective element as claimed in claim 1.

* * * * *